US007276863B2

(12) United States Patent
Lee et al.

(10) Patent No.: US 7,276,863 B2
(45) Date of Patent: Oct. 2, 2007

(54) LED ARRAY DRIVING APPARATUS AND BACKLIGHT DRIVING APPARATUS USING THE SAME

(75) Inventors: Sang Yun Lee, Kyungki-do (KR); Ju Young Gong, Seoul (KR)

(73) Assignee: Samsung Electro-Mechanics Co., Ltd. (KR)

( * ) Notice: Subject to any disclaimer, the term of this patent is extended or adjusted under 35 U.S.C. 154(b) by 0 days.

(21) Appl. No.: 11/319,723

(22) Filed: Dec. 29, 2005

(65) Prior Publication Data

US 2006/0175986 A1 Aug. 10, 2006

(30) Foreign Application Priority Data

Feb. 4, 2005 (KR) ..... 10-2005-0010387

(51) Int. Cl.
*H05B 37/02* (2006.01)

(52) U.S. Cl. ..... 315/307; 315/308; 315/312; 315/DIG. 4; 363/79

(58) Field of Classification Search ..... 315/169.1, 315/169.3, 312, 291, 179, 307, 308, 360, 315/DIG. 4; 363/73, 79; 345/82
See application file for complete search history.

(56) References Cited

U.S. PATENT DOCUMENTS 6,016,038 A * 1/2000 Mueller et al. ..... 315/291
6,023,037 A * 2/2000 Church et al. ..... 219/121.39
6,474,839 B1 * 11/2002 Hutchison ..... 362/235
6,636,003 B2 * 10/2003 Rahm et al. ..... 315/179
6,933,767 B2 8/2005 Bucks et al. ..... 327/530
7,081,708 B2 * 7/2006 Ito et al. ..... 315/82
2004/0245946 A1 * 12/2004 Halter ..... 315/312

* cited by examiner

*Primary Examiner*—Douglas W. Owens
*Assistant Examiner*—Jimmy Vu
(74) *Attorney, Agent, or Firm*—McDermott Will & Emery LLP

(57) ABSTRACT

The present invention relates to an LED array driving apparatus and a backlight driving apparatus using the same which enables regulation of analogue and PWM dimming for each channel and LED of a backlight, thereby allowing uniform luminance and color in all regions of backlight. The invention converts power with a constant voltage regulator to provide PWM pulse type power to the LED array having a plurality of LEDs connected in series. It regulates the on/off interval of the constant voltage regulator via a PWM dimmer to adjust the duty ratio of the PWM pulse. Further, it regulates the level of the driving current detected at the LED array via the feedback controller and analogue dimmer to apply to the constant voltage regulator by feedback process, thus regulating the amplitude of the PWM pulse.

9 Claims, 7 Drawing Sheets

| channel | R | G1 | G2 | B |
|---|---|---|---|---|
| CH1 | 90 | 60 | 60 | 80 |
| CH2 | 90 | 60 | 60 | 80 |
| CH3 | 90 | 60 | 60 | 80 |
| CH4 | 90 | 60 | 60 | 80 |
| CH5 | 90 | 60 | 60 | 80 |
| CH6 | 90 | 60 | 60 | 80 |

FIG. 6a

| channel | R | G1 | G2 | B |
|---|---|---|---|---|
| CH1 | 94 | 69 | 69 | 99 |
| CH2 | 94 | 69 | 69 | 99 |
| CH3 | 74 | 60 | 60 | 93 |
| CH4 | 74 | 60 | 60 | 93 |
| CH5 | 94 | 69 | 69 | 99 |
| CH6 | 94 | 69 | 69 | 99 |

FIG. 6b

LED ARRAY DRIVING APPARATUS AND BACKLIGHT DRIVING APPARATUS USING THE SAME

CLAIM OF PRIORITY

This application claims the benefit of Korean Patent Application No. 2005-10387 filed on Feb. 4, 2005, in the Korean Intellectual Property Office, the disclosure of which is incorporated herein by reference.

BACKGROUND OF THE INVENTION

1. Field of the Invention

The present invention relates to an LED array driving apparatus for supplying power to drive an LED array for an LED backlight. More particularly, the present invention relates to an LED array driving apparatus and a backlight driving apparatus using the same which allows regulation of analogue and Pulse Width Modulation (PWM) dimming for each channel and LED of an LED backlight, thereby achieving uniformity of luminance and color in all regions of a backlight.

2. Description of the Related Art

A backlight is a device for illuminating a display panel which used to adopt Cold Cathode Fluorescent Lamp (CCFL) as a light source in the prior art. However, a Light Emitting Diode (LED) has gained popularity recently as a light source since the CCFL was found to have several problems including environmental pollution due to use of mercury, slow response time of about 15 ms, low color reproductibility of 75% compared with National Television System Committee (NTSC), and generation of pre-set white light. Compared with CCFL, the LED is environmentally friendly, is possible in high-speed response in nano-seconds, is possible in impulse driving, is 100% in color reproductibility, and is possible in regulation of luminance and color temperature of a backlight by adjusting luminous flux of red, blue, and green LEDs.

In the prior art, the LED driving circuit used as a light source of a backlight may take a form of buck or boost type DC-DC converter to turn on or off the LED.

FIG. 1 illustrates an LED array driving circuit for a buck type backlight proposed in the prior art in which a DC-DC converter 11, which raises supply voltage to a predetermined DC level, is connected to an anode of the LED array 10 having a grounded cathode. The DC-DC converter 11 includes a transistor Q1 disposed in series on the power line to switch on or off; a PIN diode D1 connected in reverse direction between an output end of the transistor Q1 and a ground; an inductor L1 for connecting the output end of the transistor Q1 with the LED array 10; and a capacitor C1 disposed between the contact point of the inductor L1 with the LED array 10 and the ground.

In addition, the LED array 10 is driven by constant voltage with an error amplifier 12 for using an output voltage applied from the DC-DC converter 11 to the LED array 10 as a reference voltage of a predetermined level, a comparator 14 for comparing an output signal of the error amplifier 12 with a signal applied from a local oscillator 13, and an operation amplifier 16 for current-limiting the output signal from the comparator 14 to apply to the transistor Q1 as a switching regulation signal. In the above process, the current limiter 15, connected to the operation amplifier 16, has the function of regulating the current-limiting operations.

However, when the above prior art driving circuit is used to drive the LED array with a plurality of LEDs connected in series, luminous flux varies for each LED due to deviation in forward voltage of each LED. Thus, in order to reduce the deviation in luminous flux between the LEDs connected in series, constant-current driving rather than constant-voltage driving is required.

If the backlight with the above described driving circuit is a vertical-descent type with an LED located in the lower part of the display panel, since a plurality of LED arrays are disposed in a predetermined interval to one another, and each LED array has a driving circuit of FIG. 1, independent driving may cause deviation in luminous flux for each LED array. In addition, in case of a backlight using a side illumination type LED, there occurs a phenomenon of luminance at the center being higher than the peripheral part due to the optical and mechanistic properties of a backlight unit, which requires regulation of luminous flux for each location.

In other words, a prior art driving circuit cannot satisfy the above described needs and particularly, it has not succeeded in taking advantage of the merit of LED which is being able to change luminance and color temperature.

SUMMARY OF THE INVENTION

The present invention has been made to solve the foregoing problems of the prior art and it is therefore an object of the present invention to provide an LED array driving apparatus and a backlight driving apparatus using the same which allows regulation of analogue and PWM dimming for each channel and LED of an LED backlight, thereby achieving uniformity in luminance and color in all regions of a backlight.

According to an aspect of the invention for realizing the object, the present invention provides an LED array driving apparatus for driving an LED array having a plurality of LED elements connected in series, and the LED array driving apparatus includes:

- a PWM driver for providing PWM driving power of a predetermined frequency to an LED array, and regulating the magnitude of PWM driving power to maintain consistent forward driving current in accordance with a feedback signal corresponding to forward driving current of the LED array;
- a current sensor for sensing forward driving current running on the LED array driven by the PWM driver;
- a feedback controller for converting forward driving current running on the LED array into a feedback signal to provide to the PWM driver;
- an analogue dimmer for regulating the level of a feedback signal provided from the feedback controller to the PWM driver; and
- a PWM dimmer for regulating the duty ratio of the PWM driving signal provided from the PWM driver in accordance with the PWM dimming signal.

BRIEF DESCRIPTION OF THE DRAWINGS

The above and other objects, features and other advantages of the present invention will be more clearly understood from the following detailed description taken in conjunction with the accompanying drawings, in which:

FIGS. 6*a* and 6*b* are tables comparing the duty regulation status for each LED using the prior art driving circuit with the duty regulation status for each LED using the present invention.

DETAILED DESCRIPTION OF THE PREFERRED EMBODIMENT

The following description will present an LED array driving apparatus and a backlight driving apparatus using the same of the invention with reference to the accompanying drawings.

Figure 1:
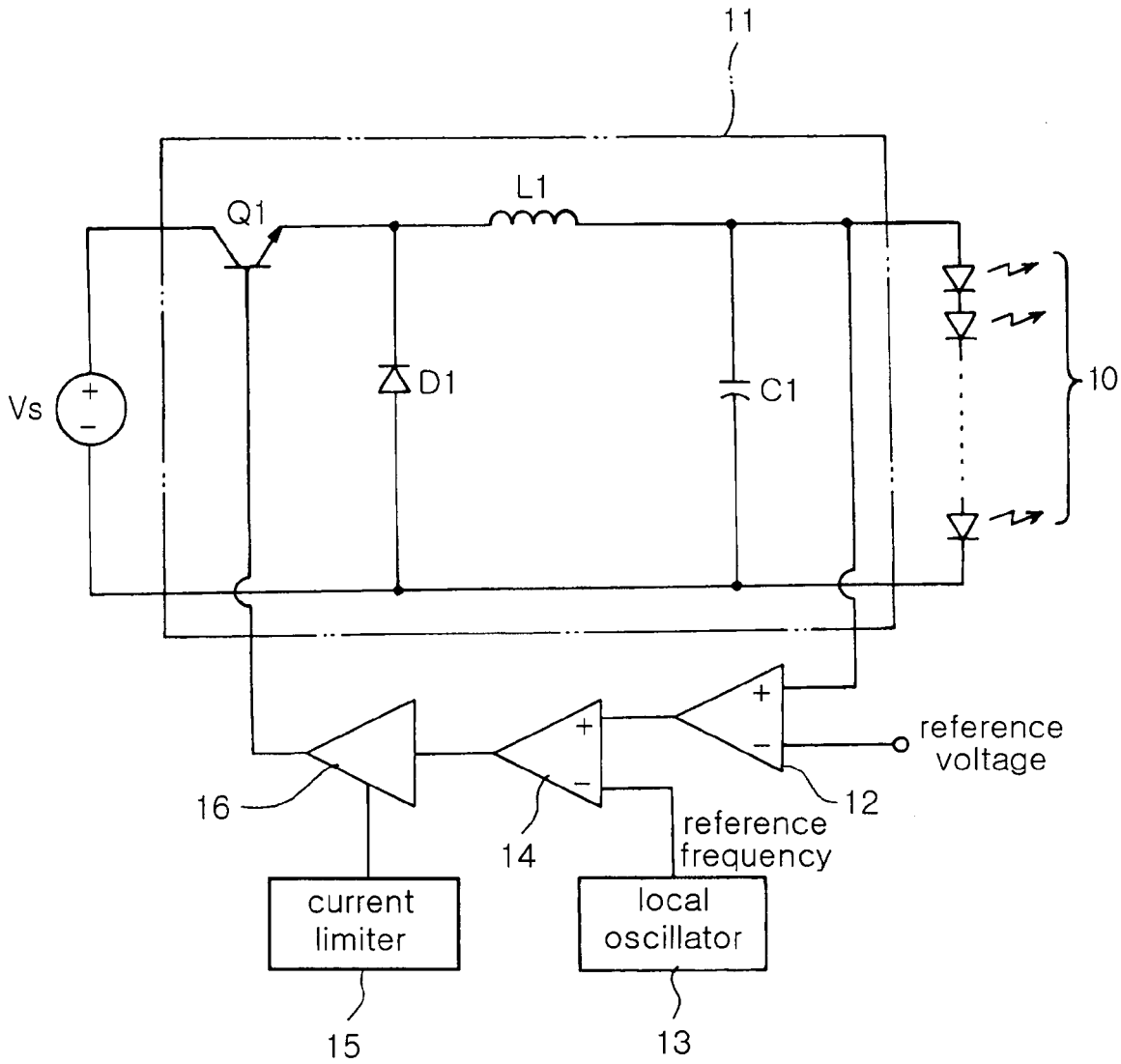
Prior art FIG. 1
FIG. 1 illustrates a prior art LED array driving circuit.
Figure 2:
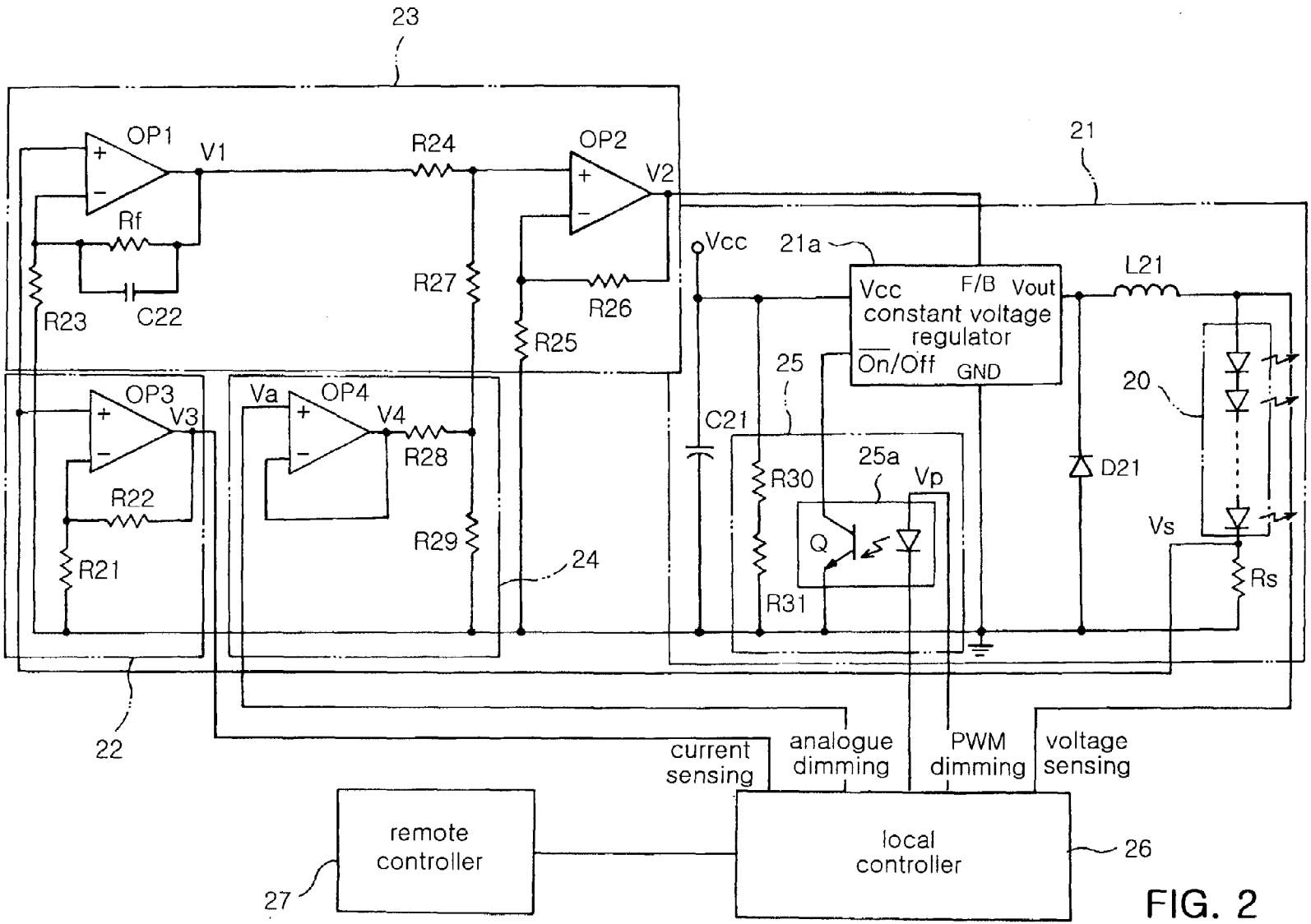
FIG. 2 is a circuit diagram illustrating an LED array driving apparatus according to the present invention.

With reference to FIG. 2, an LED array driving apparatus of the present invention includes: a PWM driver 21 for providing PWM driving power to an LED array 20 with a plurality of LEDs connected in series, and for adjusting the magnitude of PWM driving power according to a feedback signal corresponding to forward driving current of the LED array 20; a current sensor 22 for detecting forward driving current running on the LED array 20 driven by the PWM driver; a feedback controller 23 for converting forward driving current running on the LED array 20 to provide to the PWM driver; an analogue dimmer 24 for regulating the feedback signal level provided by the feedback controller 23 according to an analogue dimming signal provided from outside; and a PWM dimmer 25 for regulating the duty ratio of a PWM driving signal provided by the PWM driver 21 according to a PWM dimming signal provided from outside.

According to the above construction, an LED array driving apparatus is able to drive by constant-current an LED array 20 having a plurality of LED elements connected in series, and analogue and PWM dimming is possible.

The specific constructions and operations of each constituent are as follows. The PWM driver 21 includes a constant voltage regulator 21*a* for converting power Vcc into a predetermined level of constant voltage, an inductor L21 for connecting an output end Vout of the constant voltage regulator 21*a* with an anode of the LED array 20, a current sensing resistor present between a cathode of the LED array 20 and a ground, a PIN diode D21 connected in a reverse direction between the output end Vout of the constant voltage regulator 21*a* and a ground, and a capacitor C21 disposed between a power Vcc input end of the constant voltage regulator 21*a* and the ground.

The constant voltage regulator 21*a* may be realized in a form of generally-used constant voltage switching regulator Integrated Circuit (IC), more specifically, a voltage step-down type or buck type having five input/output pins, with all voltage and current outputted from the constant voltage regulator 21*a* is in a form of pulse.

Figure 3:
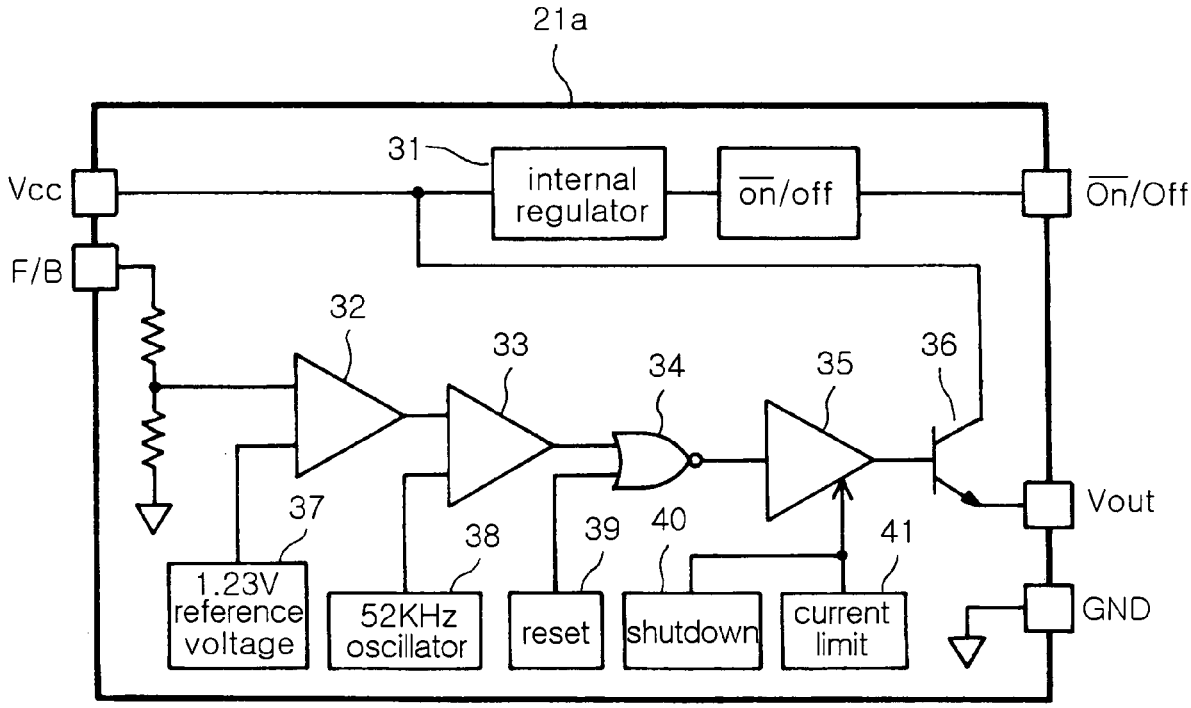
FIG. 3 is a circuit diagram illustrating a detailed construction of a constant voltage regulator in the LED array driving apparatus according to the present invention.

FIG. 3 illustrates a circuit of the constant voltage regulator 21*a* according to the present invention. Referring to FIG. 3, the constant voltage regulator 21*a* has 5 exterior pins, each for a power input end Vcc, an on/off controller $\overline{\text{On}}$/Off, a feedback end F/B, an output end Vout, and a ground end GND. The power received at the input end is applied to an internal regulator 31 to be adjusted by constant voltage, and an on/off signal applied to the on/off controller $\overline{\text{On}}$/Off turns on/off the operation of the internal regulator 31. In the present invention, a PWM pulse driving signal is produced via the on/off controller $\overline{\text{On}}$/Off, which will be explained in more details in the section on the PWM dimmer 25. In addition, the voltage applied to the feedback end of the constant voltage regulator 21*a* is received by an amplifier of fixed gains 32 to amplify and output the deviation from the reference voltage 37. This deviation is applied to a comparator 33 to be compared with the reference signal applied from an oscillator 38. The output signal of the comparator 33 is applied to a NOR gate 34 to be received by a driver 35 driving a switching transistor 36. The driver 35 turns on or off the switching transistor 35 according to the signal outputted from the NOR gate 34 to output the voltage adjusted at the internal regulator 31 into a PWM pulse signal which is then outputted through the output end Vout.

The above described construction of the constant voltage regulator 21*a* is generally known, except that the capacitor was omitted at the output end so that the output signal is in a form of pulse.

The PWM driver 21 of the present invention receives a signal applied to the feedback end F/B of the constant voltage regulator 21*a* as driving current of the LED array 20 detected through a sensing resistor Rs, so that the constant voltage regulator regulates the output voltage Vout according to the change in driving current running on the LED array, thereby regulating to maintain a consistent level of driving current running on the LED array 20.

The above described feedback controller 23 includes: a first operation amplifier OP1 for conducting non-inversion amplification on the driving voltage Vs on the sensing resistor Rs connected to the cathode of the LED array 20; a resistor Rf and a capacitor C22 connected in parallel between an inversion end and an output end of the first operation amplifier OP1; a resistor R23 for grounding the inversion end of the first operation amplifier OP1; a second operation amplifier OP2 for receiving at a non-inversion end an output signal from the first operation amplifier OP1 through a resistor for amplifying the signal to apply to the feedback end F/B of the constant voltage regulator 21*a*; a resistor R25 for connecting the inversion end of the second operation amplifier OP2 and the ground; and a resistor R26 connected between the inversion end and an output end of the second operation amplifier OP2.

The feedback controller 23 applies, by feedback process, forward driving current on the LED array 20 to the feedback end F/B. The constant voltage regulator 21*a* then conducts level-comparison of the feedback signal and the predetermined voltage and also conducts phase-comparison with the reference frequency signal to drive the LED array 20 by constant voltage.

At this time, the amplification factor at the operation amplifier OP1 of the feedback controller 23 may be determined by the ratio of the resistor connected to the cathode of the LED array 20 to the resistor connected to the first operation amplifier OP1. Thus, the amplitude of the driving current applied to the LED array 20 may be set by adjusting the resistance values of the resistors Rs and Rf. For example, as the value of the resistor Rs or Rf is decreased, the amplitude of the forward driving current of the LED array 20 becomes higher. Conversely, as the value of the resistor Rs or Rf is increased, the amplitude of the forward driving current of the LED array 20 becomes lower.

The current sensor 22, which is means to sense the forward driving current detected through the sensing resistor Rs connected to the cathode of the LED array 20, includes a third operation amplifier OP3 connected to a non-inversion end of a resistor Rs and a pair of resistors R21 and R22 connected to an inversion end of the third operation amplifier OP3.

In case of driving the LED array 20, the current sensor with the above construction detects forward driving current running on the LED array 20 to output into a certain amount of voltage signal. Checking the signal outputted from the current sensor 22 as in the above process allows monitoring the driving condition of the LED array 20, and automatic regulation by means of the local controller 26, the remote controller 27, etc, which will be explained hereunder.

In the present invention, the user can adjust the amplitude of the driving signal applied to the LED array 20 via the analogue dimmer 24.

The analogue dimmer 24 receives the analogue dimming signal Va to amplify, thereby regulating the feedback signal applied to the constant voltage regulator 21*a* through the feedback controller 23. The analogue dimmer 24 includes a fourth operation amplifier OP4 for conducting non-inversion amplification on the analogue dimming signal Va provided from outside, a resistor R28 for connecting an output end of the fourth operation amplifier OP4 with the non-inversion input end of the second operation amplifier OP2 of the feedback controller 23 through a resistor R27, and a resistor R29 for grounding the resistor R28.

The output voltage V4 of the fourth operation amplifier OP4 of the analogue dimmer 24 is the amplified product of the analogue dimming signal Va provided from outside, which is received at the non-inversion end of the second operation amplifier OP2 together with the output voltage V1 of the first operation amplifier OP1 of the feedback controller 23. The second operation amplifier OP2 processes the voltages, V1, V2, and V4 by operation. At this time, given that the resistance values of the resistors R24, R25, and R26 connected to the second operation amplifier OP2 are all the same, the output voltage V2 of the second amplifier OP2 satisfies the following mathematical equation 1:

$$V2 = V1 - \left(\frac{R28}{R28 + R29}\right)Va \qquad \text{Equation 1}$$

With reference to the mathematical equation 1 above, as the analogue dimming signal Va is increased, the feedback voltage applied from the feedback controller 23 to the constant voltage regulator 21*a* is decreased, which results in the constant voltage regulator 21*a* operating to increase the amplitude of the output voltage, and thus, the amplitude of the driving current applied to the LED array 20 becomes higher. Conversely, as the analogue dimming signal Va is decreased, the feedback voltage v2 applied from the feedback controller to the constant voltage regulator 21*a* is increased, which results in the constant voltage regulator 21*a* operating to decrease the amplitude of the output voltage, and thus, the amplitude of the driving current applied to the LED array 20 becomes lower. Therefore, by adjusting the analogue dimming signal Va, the luminance of the corresponding LED array 20 can be regulated.

Lastly, the present invention is capable of regulating PWM driving and dimming by connecting the on/off controller $\overline{\text{On}}$/Off of the constant voltage regulator 21*a* to the PWM dimmer 25, and turning on or off the constant voltage regulator 21*a* with the predetermined duty ratio.

More specifically, the PWM dimmer 25 includes: a photodiode PD which receives a PWM dimming signal Vp provided from outside; a photocoupler 25*a* composed of a phototransistor Q disposed between the on/off controller $\overline{\text{On}}$/Off of the constant voltage regulator 21*a* and the ground; and a pair of resistors R30 and R31 connected in series between a power end Vcc and the ground, having a contact point connected to the collector end of the phototransistor Q of the photocoupler 25*a*.

Therefore, a PWM dimming signal Vp is applied to the PWM dimmer 25 as a PWM pulse signal, at which time, the duty ratio may be adjusted to enable PWM driving of the LED array 20 as well as PWM dimming.

In addition, the LED array driving apparatus according to the present invention further includes a local controller 26 and a remote controller 27, as means of automatic regulation of the above described driving elements.

The local controller 26 includes a Micro Control Unit (MCU) which transmits forward current and forward voltage of the LED array 20 to the remote controller 27, and applies a regulation signal to the analogue dimmer 24 and PWM dimmer 25 in accordance with the instruction from the remote controller 27.

To realize the above, the local controller 26 is connected to the anode of the LED array 20 to output the driving voltage of the anode into a voltage sensing value, and connected to the output end of the third operation amplifier OP3 of the current sensor 22 to output the output voltage into a current sensing value, and also connected to the analogue and PWM dimmers 24 and 25 to output an analogue/PWM dimming signal.

On the other hand, the remote controller 27 may be realized as software in a personal computer or as means for managing user interface by separate external equipment. It monitors forward current and forward voltage of the LED array 20 transmitted from the local controller 26 as well as the duty ratio of the PWM regulation, providing an analogue dimming regulation value and the PWM duty ratio to be set by the user, and subsequently providing this set regulation value by the user to the local controller 26.

Therefore, the user may freely change the duty ratio of the PWM dimming regulation value and the analogue dimming regulation value of the LED array 20 in accordance with the user interface provided from the remote controller 27.

For example, once the user inputs a duty ratio value via the remote controller 27, the local controller 26 internally stores this inputted duty ratio value, and applies the PWM dimming signal Vp to the PWM dimmer 25 during the on time equivalent to the stored duty ratio value. Thus, the constant voltage regulator 21*a* is turned on or off by the above determined duty ratio to apply the pulse signal of the duty ratio instructed from the constant voltage regulator 21*a* to the LED array 20.

Figure 4A:
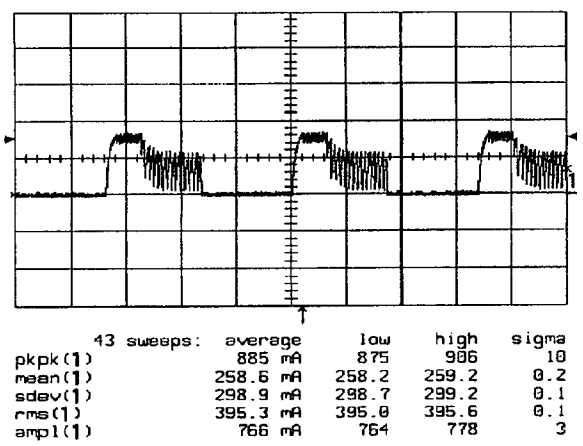
FIG. 4 shows graphs illustrating waveforms of forward current regulated by the LED array driving apparatus according to the present invention.
Figure 4B:
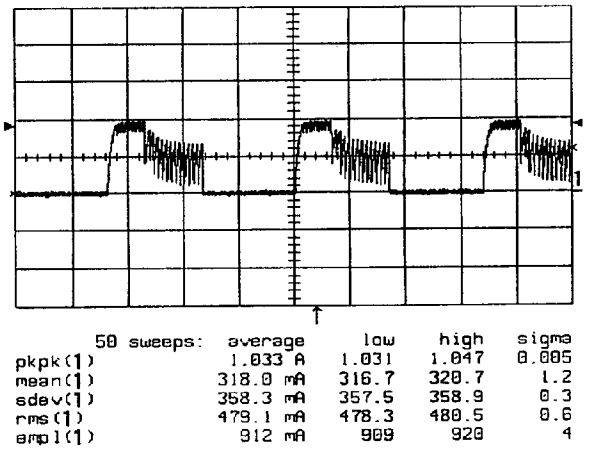
Figure 4C:
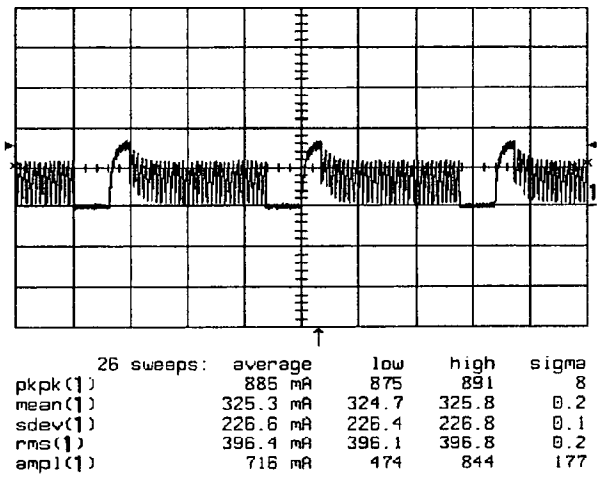

FIGS. 4*a* and 4*c* show the measurement of the driving current detected from each LED array 20 when the duty ratio is set at 50%, and at 80%, respectively, via the remote controller 27 in the LED driving apparatus of the present invention. Examining FIGS. 4*a* in contrast with 4*c*, it is noticeable that the on/off duty ratio of the driving pulse is actually changed.

Figure 4D:
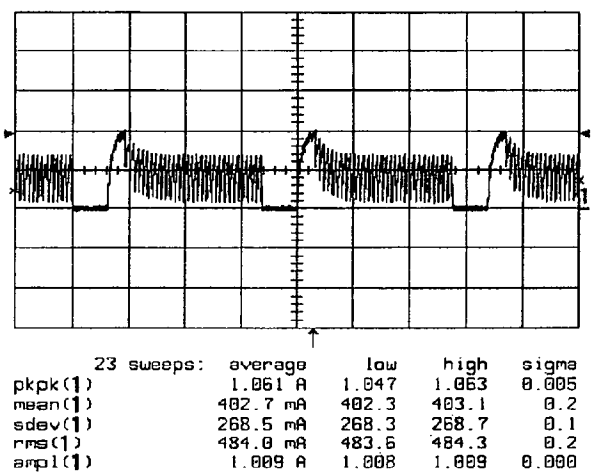

Further, FIGS. 4*b* and 4*d* indicate the measurement of the changes in the amplitude of the driving current applied to the LED array 20 as the user decreases the analogue dimming signal Va via the remote controller 27, from the PWM duty ratios shown in FIGS. 4*a* and 4*c*. The waveforms of FIGS. 4*b* and 4*d* in contrast with those of FIGS. 4*a* and 4*c* show that the amplitude of pulse is actually increased.

In the LED array driving apparatus set forth above, simultaneous and individual regulation of a plurality of LED arrays 20 may be conducted by providing in each LED array 20 a circuit composed of the PWM driver 21, the current sensor 22, the feedback controller 23, the analogue dimmer 24, and the PWM dimmer 25, and connecting the plurality of circuits to a single local controller 26 and remote controller 27.

Figure 5:
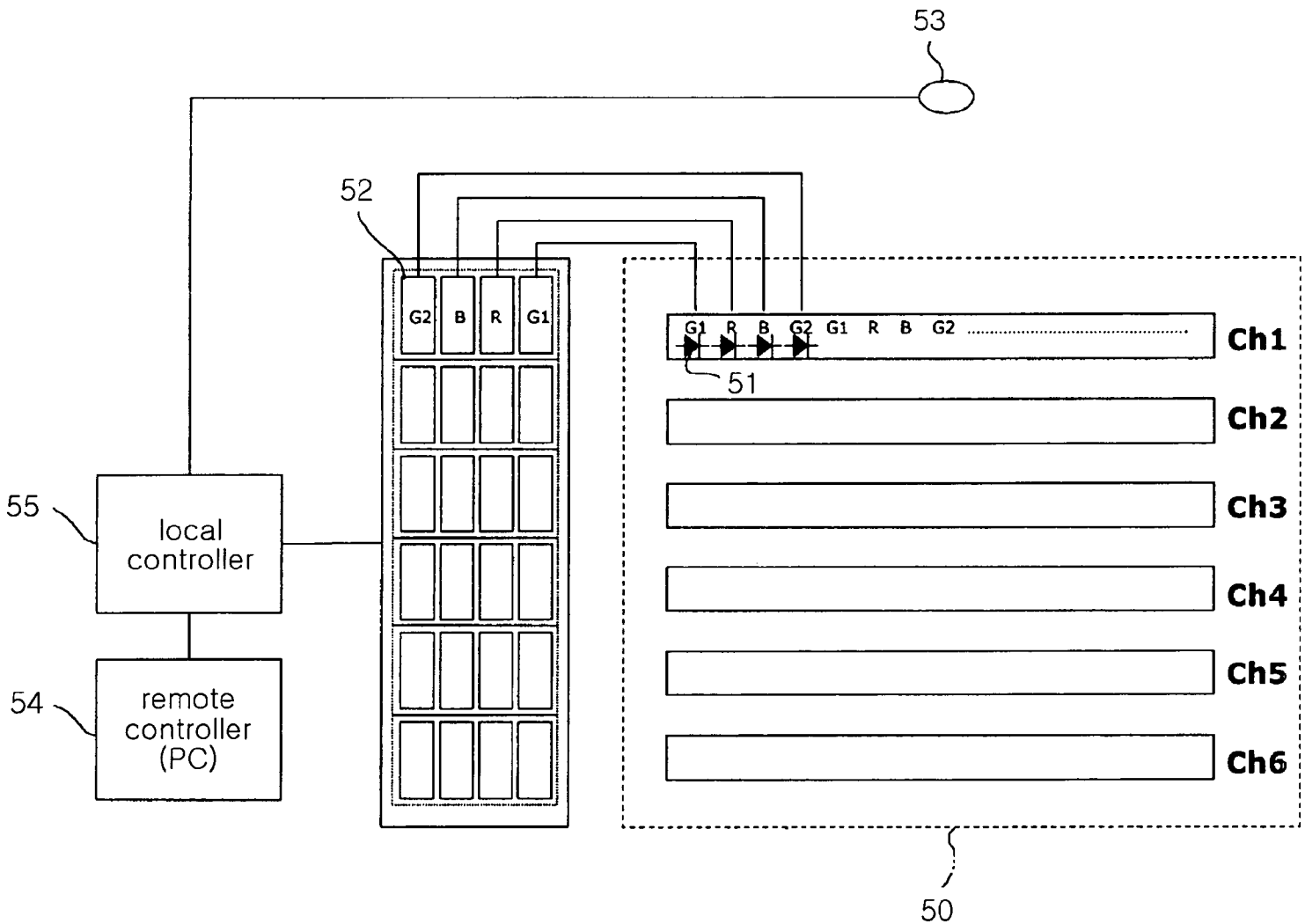
FIG. 5 is a block diagram illustrating an example in which the LED display apparatus of the present invention is used in backlight driving of an LED display apparatus.

FIG. 5 shows an example of a backlight apparatus using the LED array driving apparatus of the present invention. The backlight apparatus 50 illustrated in FIG. 5 has five LED arrays, displaying each LED array via channels Ch1-Ch6. In each channel Ch1-Ch6, a plurality of LEDs, i.e. the first green, red, blue, the second green LEDs G1, R, B, and G2 are arranged in series in their order, with the same types of LEDs connected together in series.

The backlight apparatus 50 includes: a plurality of LED array driving circuits 52 for sensing and providing the driving voltage and current for each channel, for the same color LEDs in each LED array, and for applying the driving power to the same channel and color in accordance with the instructed PWM duty ratio and an analogue dimming value; a local controller 55 for receiving a driving current and voltage sensing signal from each LED array driving circuit 52 to provide to a remote controller 54, and for providing the duty ratio and the analogue dimming value for each channel, and LED type provided by the remote controller to the LED array driving circuit 52; and the remote controller 54 for providing user-monitoring on the driving current and voltage sensing signal for each channel and LED transmitted from the local controller 55 and for receiving the analogue dimming value and the duty ratio for each channel and LED from the user to provide to the local controller 55.

According to the above construction, the user is able to regulate luminous flux of the plurality of LED arrays in the back light according to the needs by setting the duty ratio and the analogue dimming value for each channel and LED via the remote controller 54.

Moreover, the present invention further includes a color sensor 53 for detecting the luminance and bandpass in all regions of the backlight 50, which is connected to the remote controller 54 through the local controller 55, thereby regulating the duty ratio and the analogue dimming value for each channel and LED type to compensate for the differences between the target luminance and chromaticity, and the actual luminance and chromaticity.

However, in case of adjusting the RGB ratio with the color sensor 53, uniform luminance and color may not be obtained if there are luminous flux differences and color deviation between the channels.

Therefore, in the above backlight driving apparatus, it may be desirable that the user performs analogue and PWM dimming for each channel and LED via the remote controller 54 to tune the uniformity of luminance and color in the backlight 50, and store the duty ratio for each channel and LED as defaults in the local oscillator 55 before driving the color sensor 53, so that the user operates the color sensor 53 afterwards to ensure the luminance and color deviation detected from the color sensor 53.

FIG. 6*a* represents the condition in which the duty is pre-set to provide the same R, G, and B ratios for all channels Ch1-Ch6 in the backlight shown in FIG. 5. In all channels, the ratio of red LED R is set at 90%, green LED G1 and G2 at 60%, and blue LED B at 80%. This is a condition set for the backlight driving apparatus using the prior art driving circuit, which is plagued by the problem of the center of the backlight screen having high luminance while low luminance in the peripheral part when the duty ratios are set the same for all channels (i.e. the locations of LED).

On the contrary, FIG. 6*b* represents a condition for using the driving apparatus shown in FIG. 5, in which R, G, and B duty ratios are adjusted for each channel taking account of the luminance differences in different locations due to the structure of the backlight 50. Here, the duty ratios for channels Ch3 and Ch4 located in the center of the backlight are set smaller than those of the channels Ch1, Ch2, Ch5, and Ch6 located in the peripheral part of the backlight 50, thereby achieving uniform luminance of the center and the peripheral part.

Figure 7A:
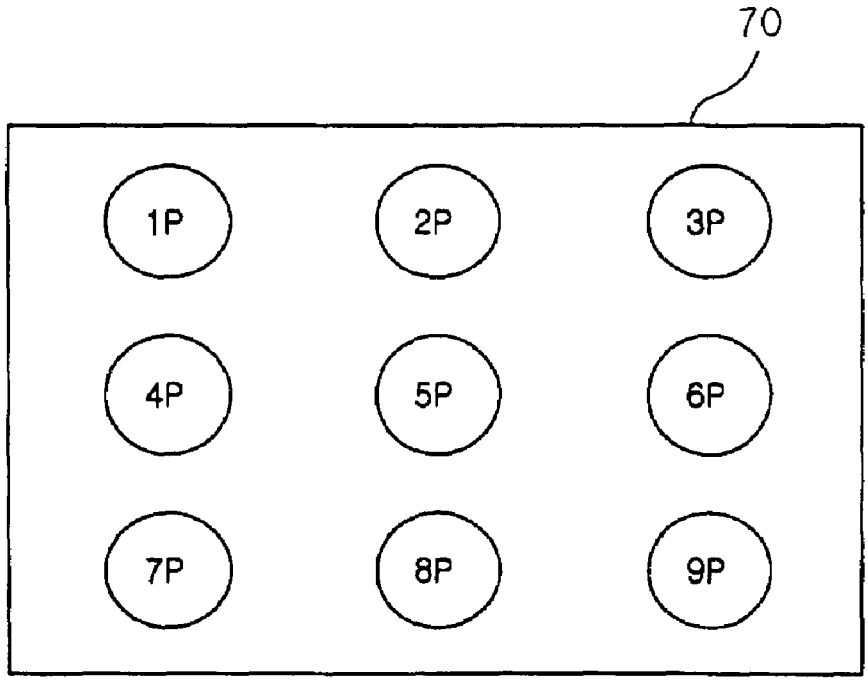
FIG. 7*a* illustrates the measurement locations of panel luminance in the backlight shown in FIG. 5.
Figure 7B:
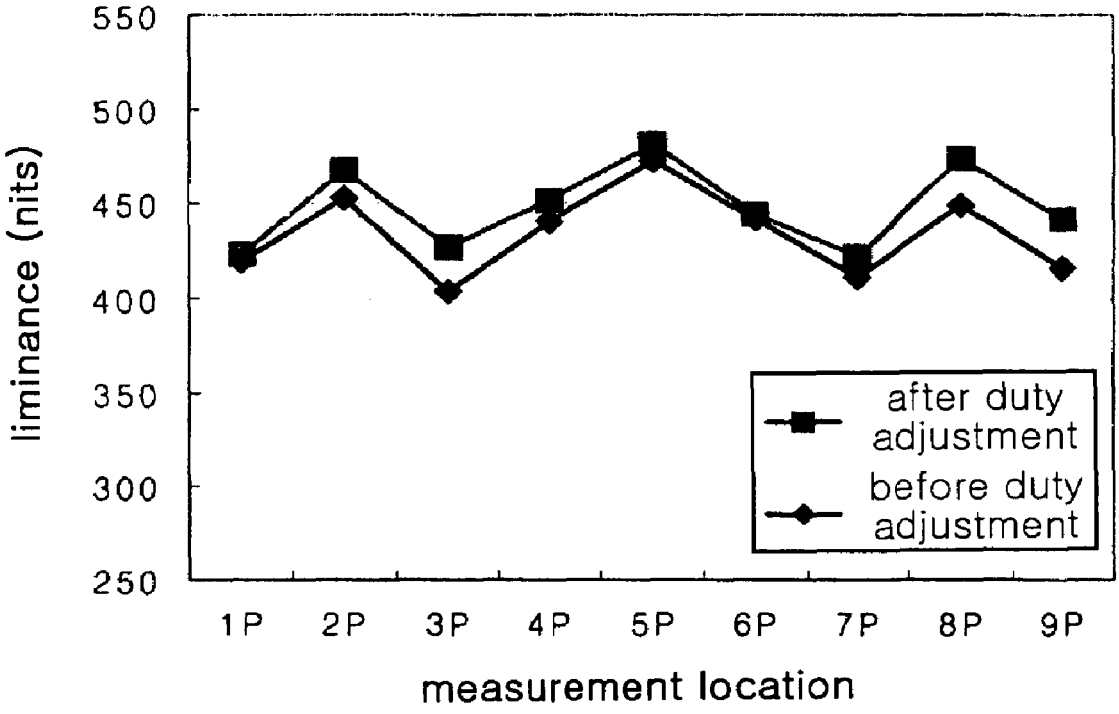
FIG. 7*b* is a graph comparing luminance before and after the regulation of the duty ratio, measured at each of the above locations.

FIG. 7*a* illustrates different locations in the backlight screen 70 where luminance is measured to observe the luminance differences according to the adjustment of the duty ratios as shown in FIG. 6. FIG. 7*b* is a graph comparing the luminance before and after the adjustment of the duty ratios such as in FIGS. 6*a* and 6*b*, measured at different locations in FIG. 7*a*.

Examining the graph in FIG. 7*b*, it is noticeable that the uniformity of luminance is improved from 85% to 88% when the duty ratios are adjusted as in FIG. 6*b*, compared with prior to the adjustment of the duty ratios as in FIG. 6*a*. The uniformity of luminance may be further improved by adjusting the duty ratios differently for each channel.

As discussed above, the LED array driving apparatus according to the present invention may prevent the occurrence of the deviation in luminous flux due to the deviation in driving voltage. Further, the present invention enables obtainment of the desired luminance and color quality by allowing feedback-control of the amplitude of the PWM duty ratio and driving current of the LED arrays.

Furthermore, in the backlight driving apparatus using the LED array driving apparatus according to the present invention, individual regulation of the PWM duty ratio and amplitude of the driving power for each channel and LED is possible in a plurality of LED arrays used as a light source of the backlight, enabling compensation for the deviation due to the structural characteristics of the backlight, resulting in improved uniformity of luminance and color in the backlight.

While the present invention has been shown and described in connection with the preferred embodiments, it will be apparent to those skilled in the art that modifications and variations can be made without departing from the spirit and scope of the invention as defined by the appended claims.

What is claimed is:

1. An apparatus for driving an LED array, which includes a plurality of LED elements connected in a series, comprising:

a Pulse Width Modulation (PWM) driver for providing a predetermined frequency of PWM driving power to the LED array, and regulating the magnitude of PWM driving power in order for forward driving current to be consistent in accordance with a feedback signal corresponding to the forward driving current of a specific LED;

a current sensor for outputting forward driving current running on the LED array driven by the PWM driver into a predetermined range of voltage signal;

a feedback controller for converting forward driving current running on the LED array into a feedback signal and providing the feedback signal to the PWM driver;

an analogue dimmer for regulating the level of a feedback signal provided by the feedback controller to the PWM driver in accordance with an analogue dimming signal; and a PWM dimmer for regulating duty ratio of a PWM driving signal provided by the PWM driver in accordance with a PWM dimming signal.

2. The LED array driving apparatus according to claim 1, wherein the PWM driver comprises:

a constant voltage regulator for converting power into a predetermined level of constant voltage and outputting it;

an inductor for connecting an output end of the constant voltage regulator with an anode of LED array;

a current sensing resistor present between a cathode of the LED array and a ground;

a Positive Intrinsic Negative (PIN) diode connected in a reverse direction between an output end of the constant voltage regulator and the ground; and a capacitor disposed between the input end of the constant voltage regulator and the ground.

3. The LED array driving apparatus according to claim 2, wherein the constant voltage regulator comprises a buck or boost type constant voltage switching regulator IC having five pins, wherein the five pins are set for a power input end for receiving power to be voltage-transformed, an on/off controller for turning on/off the operation of the constant voltage regulator, a feedback end for receiving a feedback signal that controls output voltage of the constant voltage regulator, an output end for outputting regulated output voltage, and a ground end.

4. The LED array driving apparatus according to claim 2, wherein the feedback controller comprises:

a first operation amplifier for conducting non-inversion amplification to driving voltage on the sensing resistor connected to the cathode of the LED array;

a first resistor and a capacitor connected in parallel between an inversion end and an output end of the first operation amplifier;

a second resistor for grounding the inversion end of the first operation amplifier;

a second operation amplifier for receiving at a non-inversion end an output signal from the first operation amplifier through a third resistor, and amplifying the signal to apply to the feedback end of the constant voltage regulator;

a fourth resistor connecting the inversion end of the second operation amplifier with the ground; and a fifth resistor connected between the inversion end and an output end of the second operation amplifier.

5. The LED array driving apparatus according to claim 2, wherein the current sensor comprises a third operation amplifier having a non-inversion end connected to the sensing resistor, and a pair of resistors connected to an inversion end of the third operation amplifier, so as to convert output voltage of the third operation amplifier into a current sensing signal.

6. The LED array driving apparatus according to claim 4, wherein the analogue dimmer comprises a fourth operation amplifier for conducting non-inversion amplification on the analogue dimming signal; a first resistor for connecting an input end of the fourth operation amplifier to the non-inversion input end of the second operation amplifier of the feedback controller through a second resistor; and a third resistor grounding the first resistor.

7. The LED array driving apparatus according to claim 2, wherein the PWM dimmer comprises:

a photocoupler including a phototransistor disposed between an on/off input end of the constant voltage regulator and the ground and a photodiode (PD) receiving a PWM dimming signal; and a pair of resistors connected in series between a power end and the ground end, having a contact point connected to a collector end of the phototransistor of the photocoupler, so as to turn on and off the constant voltage according to the PWM dimming signal.

8. The LED array driving apparatus according to claim 1 further comprising:

a local controller for receiving forward current and forward voltage of the LED array to transmit it to a remote controller, and in accordance with the instruction from the remote controller providing an analogue dimming signal and a PWM dimming signal to the analogue and PWM dimmers; and a remote controller for monitoring forward current and forward voltage of the LED array transmitted from the local controller to provide to a user, and receiving analogue dimming control values and PWM duty ratio from the user to transmit to the local controller.

9. A backlight driving apparatus comprising:

a plurality of LED arrays disposed at each location within backlight, with first green, blue, red, and second green LEDs repetitively alternating in a predetermined order in a line, and same types of LEDs being connected in series;

a plurality of LED array driving circuits each connected to a same LED type in each LED array for providing PWM driving power having predetermined duty ratio and amplitude to each of the same LED type in accordance with an instructed analogue dimming signal and a PWM dimming signal, and detecting forward driving current and voltage running on LED;

a color sensor for detecting luminance and wavelength band for each backlight location illuminated by the plurality of LED arrays;

a remote controller for receiving from user analogue dimming value and duty ratio for each channel, and for each LED type from user; and a local controller for receiving a driving current and voltage sensing signal from the plurality of LED array driving circuits to provide to the remote controller, and providing an analogue dimming signal and PWM dimming signal to a corresponding LED array driving circuit to display a predetermined luminance by comparing the duty ratio and analogue dimming value provided by the remote controller for each LED type in each LED array, and with luminance detected by the color sensor, the remote controller receiving the driving current and voltage sensing signal for each LED type for each LED array transmitted from the local controller to provide user monitoring.

* * * * *